US006373451B1

(12) United States Patent
Kang et al.

(10) Patent No.: US 6,373,451 B1
(45) Date of Patent: Apr. 16, 2002

(54) METHOD FOR DRIVING AC PLASMA DISPLAY PANEL

(75) Inventors: Kyoung-ho Kang, Asan; Jeong-duk Ryeom; Yoon-phil Eo, both of Cheonan, all of (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/512,874

(22) Filed: Feb. 25, 2000

(30) Foreign Application Priority Data

Mar. 2, 1999 (KR) ..... 99-6730

(51) Int. Cl.[7] ..... G09G 3/28
(52) U.S. Cl. ..... 345/60; 345/67
(58) Field of Search ..... 345/60–69; 315/169.1, 315/169.4

(56) References Cited

U.S. PATENT DOCUMENTS

| | | | | |
|---|---|---|---|---|
| 5,420,620 A | * | 5/1995 | Kanazawa | 345/67 |
| 5,446,344 A | * | 8/1995 | Kanazawa | 313/169.4 |
| 6,057,815 A | * | 5/2000 | Sano | 345/60 |
| 6,232,935 B1 | * | 5/2001 | Fukushima et al. | 345/67 |

FOREIGN PATENT DOCUMENTS

| | | | |
|---|---|---|---|
| EP | 0488326 | * | 6/1992 |
| EP | 0488891 | * | 6/1992 |
| EP | 0680067 | * | 11/1995 |
| EP | 0762373 | * | 3/1997 |
| JP | 2220330 | * | 9/1990 |
| JP | 5119738 | * | 5/1993 |
| JP | 5232901 | * | 9/1993 |
| JP | 64039 | * | 1/1994 |
| KR | 7-199858 | * | 8/1995 |

* cited by examiner

*Primary Examiner*—Amare Mengistu
(74) *Attorney, Agent, or Firm*—Lowe Hauptman Gilman & Berner LLP

(57) ABSTRACT

A method for driving an AC type surface discharge structure plasma display panel according to an electrode wiring structure is provided. In the method for driving the AC plasma display panel, there is a phase difference of no more than 180° between the sustaining pulse applied to the Y electrode and the sustaining pulse applied to the X electrode in the three-electrode structure AC type plasma display panel in order to secure time for sustaining uniform wall charge and space charge characteristics. An address time slot constituted of a plurality of data pulses is set in a temporal margin space secured by collecting a plurality of sustaining pulses into a group. The data of each address time slot is assigned to time slots of a plurality of sub fields and is addressed.

16 Claims, 18 Drawing Sheets

METHOD FOR DRIVING AC PLASMA DISPLAY PANEL

BACKGROUND OF THE INVENTION

1. Field of the Invention

The present invention relates to a method for driving an AC surface discharge plasma display panel according to an electrode wiring structure.

2. Description of the Related Art

A plasma display panel is a kind of a display for restoring picture data input as an electrical signal by arranging a plurality of discharge tubes in a matrix shape and selectively emitting light from the plurality of discharge tubes. A method for driving the plasma display panel is divided into a DC driving method and an AC driving method according to whether the polarity of a pulse voltage applied in order to maintain the discharge changes as time passes.

FIG. 1 is a sectional view of an opposite orientation discharge structure plasma display panel. FIGS. 2A and 2B are respectively a sectional view and an exploded perspective view of the AC surface discharge structure plasma display panel. As shown in FIGS. 1, 2A, and 2B, a discharge space is formed between upper glass substrates 1 and 7 and lower glass substrates 4 and 12 in the DC opposite orientation discharge structure plasma display panel and the AC surface discharge structure plasma display panel, respectively. Meanwhile, in the DC plasma display panel, the flow of electrons supplied from a negative polarity is a main source of energy for maintaining the discharge since a scanning electrode 2 and an address electrode 5 are directly exposed to a discharge space 3, in the AC plasma display panel, a scanning electrode 6*a* and a common electrode 6*b* for maintaining the discharge are electrically isolated from a discharge space 10 since the scanning electrode 6*a* and the common electrode 6*b* are in a dielectric layer 8. The discharge is maintained by a well-known wall charge effect in the case of the AC type plasma display panel. Namely, since a discharge starting voltage is an addition of a voltage generated by a wall charge to an applied voltage, discharge occurs only where the wall charge exists. Since the discharge accumulates wall charges, the discharge is maintained in a place where the discharge once occurred.

Also, the plasma display panel is divided into an opposite orientation discharge structure and a surface discharge structure according to the arrangement of the electrodes for generating the discharge. Namely, in the opposite orientation discharge structure, the electrodes for generating the discharge are arranged on different surfaces, i.e., opposite surfaces as shown in FIG. 1. In the surface discharge structure, the electrodes for generating the discharge are arranged on the same surface as shown in FIG. 2A. The respective structures are divided into a two electrode structure and a three electrode structure, etc., according to the number of electrodes installed in order to easily realize a discharge.

FIG. 2B shows a three electrode surface discharge structure of the plasma display panel which is commonly used. An address electrode 11 which faces the scanning electrode 6*a* and the common electrode 6*b* which are two display electrodes formed side by side is installed in the discharge space formed by a partition wall. The discharge for generating the wall charge in order to select pixels occurs between the address electrode 11 and the scanning electrode 6*a*. Then, the discharge for displaying a picture is repeated for a predetermined time between the scanning electrode 6*a* and the common electrode 6*b*. A partition wall 17 forms the discharge space and intercepts light generated during the discharge, thus preventing generation of cross talk in adjacent pixels. Each pixel is formed by forming such unit-structure on a substrate and coating fluorescent material on the respective unit structures. These pixels are integrated in a matrix and become a plasma display panel. In the commonly used plasma display panel, the discharge occurs in the respective pixels and ultraviolet rays generated by the discharge excite the fluorescent material coated on the inner wall of the pixel, thus realizing a desired color.

In order for the plasma display panel to exhibit the function of the display panel, gray scales must be realized. In order to realize the gray scales in the plasma display panel, a time division controlling method for dividing one TV field into a plurality of auxiliary fields and displaying the auxiliary fields is used. FIG. 3 is a diagram for describing the gray scale displaying method of the AC type plasma display panel which is currently applied to products. The method is a 6-bit gray scale displaying method, where one TV field is divided into 6 auxiliary fields. Each auxiliary field is divided into address periods A1, A2, . . . , and A6 and sustaining periods S1 S2, S3, . . . , and S6. The pixel of the display panel is selected during the address periods A1, A2, . . . , and A6. The gray scales of the pixel selected during the address periods are displayed during the following sustaining periods S1, S2, S3, . . . , and S6. Accordingly, the gray scales of the pixels are displayed by the combination of the sustaining periods S1, S2, S3, . . . , and S6 selected by addressing. It is possible to display 64 ($=2^6$) gray scales by this method. Namely, the pixels selected from the plasma display panel comprised of 480 scan lines Y1, Y2, . . . , and Y480 can display a total of 64 levels, i.e., from level 0 to level 63. For example, the gray scales are displayed as follows, 0(0T), 1(1T), 2(2T), 3(1T+2T), 4(4T), 5(1T+4T), 6(2T+4T), 7(1T+2T+4T), 8(8T), 9(1T+8T), . . . , 27(1T+2T+8T+16T), . . . , 63(1T+2T+4T+8T+16T+32T).

FIG. 4 shows an example of the electrode wiring structure of the commonly used AC type plasma display panel, which is constituted of two electrode pairs (X and Y electrode pairs) which face each other and are parallel to each other in a horizontal direction and address electrodes 21 which are vertical to the X and Y electrode pairs. Here, electrodes which are commonly wired among the two horizontal electrode pairs are common electrodes (X electrodes). The other electrodes are scanning electrodes (Y electrodes). The waveform of a driving signal for driving the AC plasma display panel having such a wiring structure is shown in FIG. 5. The driving signal is used for an address division sustain (ADS) method for separately driving an address discharge and a sustaining discharge. In FIG. 5, the waveforms of the address electrode driving signal A, scanning electrode driving signals Y1, Y2, . . . , Y480, and a common electrode driving signal are shown. Here, only the signal of a first sub field SF1 is shown. A1 shows a first address period. S1 shows a first sustaining period. An address period (the first address period) is comprised of an erase time of an entire erase period A11, an entire write period A12, and an entire erase period A13 and a real address period A14 for actually selecting the pixels. During the erase period A11, a wall charge due to a previous discharge is entirely erased. During the period A12, a new wall charge is entirely written by generating weak discharge for correctly displaying gray scales. During the erase period A13, the written wall charge is entirely erased and the amount of wall charge is appropriately controlled and an appropriate amount is left, thus making the operation of a next auxiliary field harmonious. During the address period (A14), a wall charge is written in the scanning electrode of a selected pixel of the entire screen of the plasma display panel by selective discharge caused by a write pulse between the address electrode and the scanning electrode, which cross each other. The write pulse is an electrical signal into which image information is converted. During the discharge maintaining period (S1), light emission is maintained, namely, image information is realized on a real screen as real gray scales by the discharge caused by continuous sustaining pulses.

However, in the gray scale realizing method of the commonly used plasma display panel, no more than 30% of one frame image display period on the basis of the NTSC level of the 6-bit gray scale is assigned to the sustaining period since the method for driving the address discharge and the sustaining discharge in a separated state is applied. Therefore, brightness is very low, which is a large hindrance to adoption as a general display. Furthermore, when the method is applied to a display of a high definition (HD) level, the sustaining discharge period is lowered to □ of the current period. Accordingly, the brightness is reduced even further. A method of putting relatively more pulse streams in one sub-field by increasing the frequency of the sustaining pulse and narrowing the width of the sustaining pulse is searched in order to improve the brightness. When the frequency of the sustaining pulse increases, the sustaining pulse streams are temporally adjacent to each other. Accordingly, the space charge caused by the discharge generated by a preceding pulse affects the discharge characteristic of the next discharge, thus making the discharge unstable. Therefore, the increase in brightness comes to have a saturation characteristic. Also, when the width of the sustaining pulse is reduced, a time for converting the space charge generated right after the discharge into the wall charge is relatively shorter, thus increasing the sustaining voltage.

In order to avoid such a problem, an entire screen simultaneous address and sustaining discharge realizing method as shown in FIG. 6 is used instead of the method for driving the address discharge and the sustaining discharge in a separated state. In this method, address pulses 29*a*, 29*b*, and 29*c* are applied to interval periods of sustaining pulses 32 applied to the respective scanning electrodes Y1 Y2, and Y3. Erase pulses 31*a* and 31*b* for initialization and scanning pulses 33*a*, 33*b*, and 33*c* for addressing are applied to between the sustaining pulses 32 applied to the scanning electrodes Y1, Y2, and Y3. Then, a certain sustaining period is established. In the gray scale display of this method, one TV frame is entirely used for the sustaining discharge by dividing sub-frames (SF1 through SF8) as shown in FIG. 7. However, this method has many restrictions on determining the insertion timing of the address pulses since the address pulse is inserted between the sustaining pulse and the sustaining pulse. Therefore, the number of scan lines which can be actually displayed is limited. Accordingly, it is difficult to drive the display of the HD level. In order to solve this problem, it is necessary to perform high speed driving such as doubling the speed of driving and tripling the speed of driving. Even in this case, it is not possible to prevent the discharge from becoming unstable due to the increase in the frequency and the sustaining voltage from increasing due to a reduction in the width of the sustaining pulse.

SUMMARY OF THE INVENTION

To solve the above problem, it is an objective of the present invention to provide a method for driving an AC plasma display panel where it is possible to leave a margin in the insertion timing of an address pulse inserted between a sustaining pulse and a sustaining pulse and to prevent the frequency or the voltage of the sustaining pulse from increasing by setting address time slots each comprised of a plurality of data pulses between the sustaining pulses and driving a plurality of groups each group having horizontal electrode pairs whose number is the same as that of the address time slots, so as to apply the groups to a method for simultaneously driving addressing and sustaining electrodes, wherein sequentially scanning the address time slots in a plurality of groups.

Accordingly, to achieve the above objective, there is provided an AC plasma display panel driving method for driving a picture of a frame with a realization of gray scales by dividing each horizontal synchronous period into a plurality of periods, sustaining and selectively emitting light during the plurality of periods by sequentially applying a different number of sustaining pulses to scanning electrodes and common electrodes during each divided period in a k×n matrix AC plasma display panel where k electrode pairs, each of which is comprised of first and second electrodes formed in parallel on each surface of two substrates opposite to each other, are arranged in strips and n third electrodes are arranged in strips to cross the electrode pairs, each of which is comprised of the first and second electrodes, when common wiring groups are formed by wiring an m number of second electrodes into one node as a common electrode and the first electrodes are individually installed as a scanning electrode in the electrode pair, comprising the steps of (a) applying a sustaining pulse to the scanning electrode to alternate with a sustaining pulse applied to the common electrode, (b) setting an address time slot comprised of m data in a temporal marginal period secured to the sustaining pulse applied to m scanning electrodes corresponding to the common electrodes of a common electrode groups, each of which is comprised of m common electrodes, performing addressing by assigning the data of the respective address time slots to the time slots of a plurality of sub fields, and applying one scan pulse to each of the m scanning electrodes so as to be synchronized with the m data, wherein the scan pulses exist above a first bias pulse of a predetermined electric potential applied between the sustaining pulses, and (c) applying a second bias pulse of a predetermined voltage to the common electrodes of each common electrode group in a period when the address time slot which exists between the sustaining pulses exists, simultaneously with the step (b).

In the present invention, it is preferable that the step of applying the same erase pulse in units of m scanning electrodes in the same period between the sustaining pulse and the first bias pulse so that an erase period and a break period exist after an address period comprised of the address time slot period and a sustaining period to which the sustaining pulse is applied in each sub field in the steps (a), (b), and (c) is further comprised. It is preferable that the second bias pulse is continuously applied to between the sustaining pulses applied to the common electrode in the step (c).

Also, in the present invention, the sustaining pulse is preferably applied twice in the step (a). It is preferable that the second bias pulse is continuously applied to between the sustaining pulses applied to the common electrode in the step (c).

Also, in the present invention, the discharge maintaining pulse applied to the common electrode is preferably applied to the scan electrode together with the sustaining pulse applied to the scanning electrode. At this time, it is preferable that the second bias pulse is continuously applied to the common electrode in a period between the sustaining pulses applied to the scanning electrode in the step (c).

Also, in the present invention, the sustaining pulse applied to the scanning electrode is preferably applied to the common electrode together with the sustaining pulse applied to the common electrode. At this time, it is preferable that the second bias pulse is continuously applied to between the sustaining pulses applied to the common electrode in the step (c).

BRIEF DESCRIPTION OF THE DRAWING(S)

The above objective and advantages of the present invention will become more apparent by describing in detail a preferred embodiment thereof with reference to the attached drawings in which.

DESCRIPTION OF THE PREFERRED EMBODIMENTS

In the present invention, a method for applying a voltage of a three-electrode structure AC type plasma display panel where brightness is not reduced even when the brightness and the number of horizontal scanning lines are increased compared to a conventional method is provided. Namely, in the present invention, there is a phase difference of no more than 180° between the sustaining pulse applied to the Y electrode and the sustaining pulse applied to the X electrode in the three-electrode structure AC plasma display panel in order to secure time for sustaining uniform wall charge and space charge characteristics. An address pocket constituted of a plurality of data pulses is set in a temporal margin space secured by collecting a plurality of discharge maintaining pulses into a group. The data of each address pocket is assigned to pockets of a plurality of sub fields and is addressed. For this, a plurality of groups, each group consisting of as many horizontal electrode pairs as data pulses of the address time slot are formed. Ones of the horizontal electrode pairs is commonly wired to each group. The others of the horizontal electrode pairs are independently wired. Data of the address time slots in the respective electrode groups are sequentially scanned. The electrode groups are applied to an address display simultaneous driving method. The scanning pulse of the scanning electrode group synchronized with each address time slot exists above a bias pulse having an arbitrary electric potential existing between the discharge maintaining pulses. At this time, the X electrode group has a uniform electric potential in a section where the address time slot exists in a time between the sustaining pulse groups. Such a method for driving the plasma display panel will be described in detail as follows.

Figure 1:
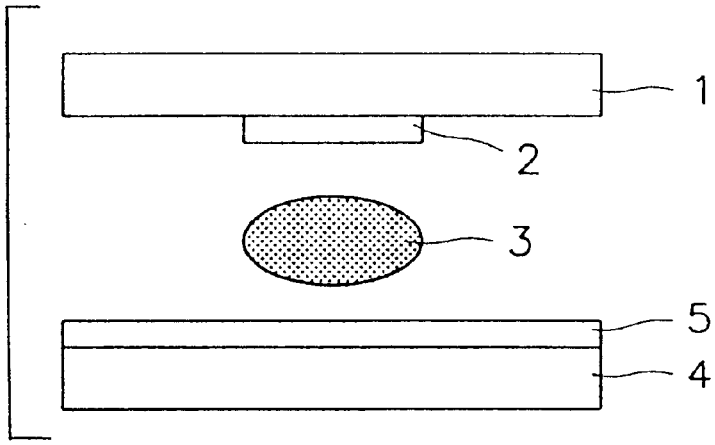
FIG. 1 is a vertical sectional view of a general DC type opposite orientation discharge structure plasma display panel.
Figure 2A:
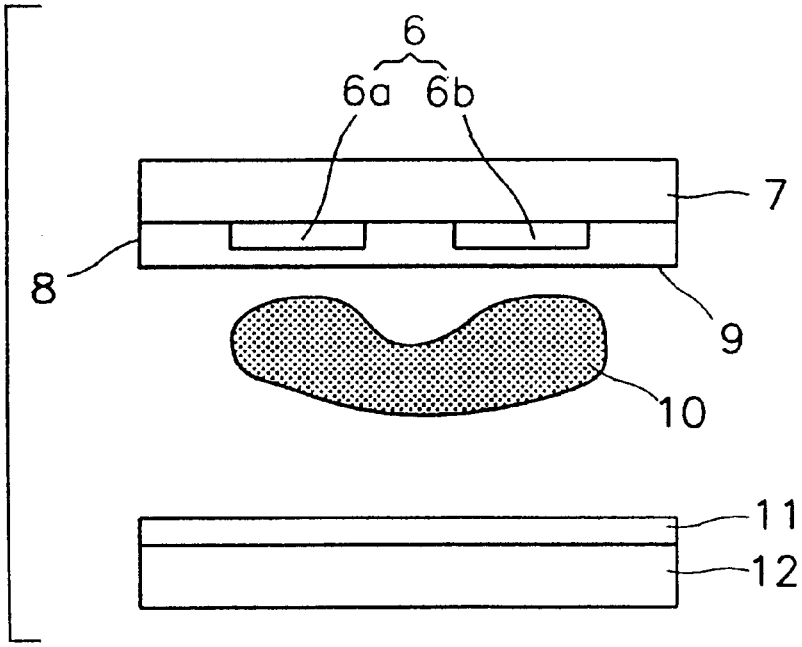
FIG. 2A is a vertical sectional view of a general AC type surface discharge plasma display panel.
Figure 2B:
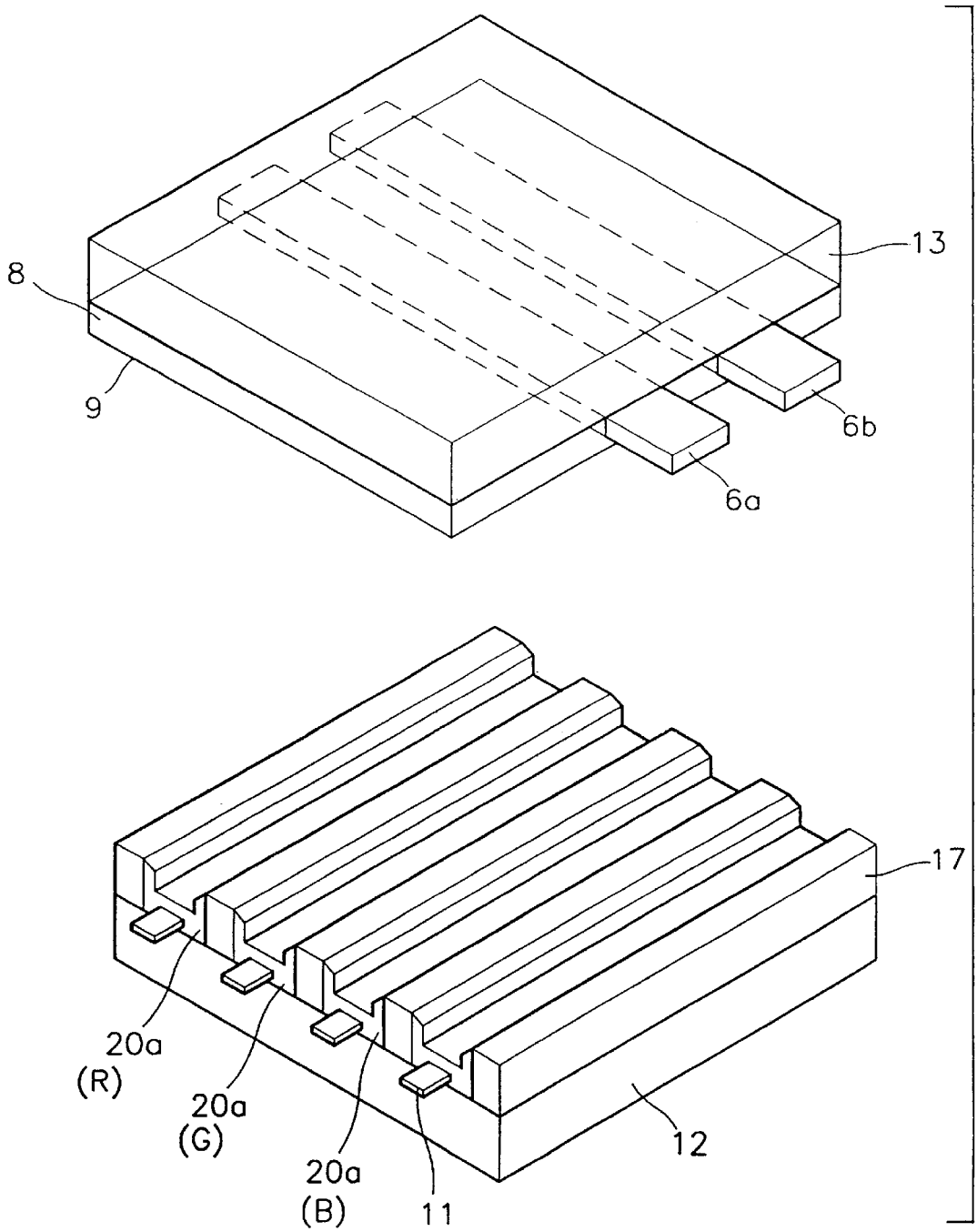
FIG. 2B is an exploded perspective view of the AC type surface discharge plasma display panel of FIG. 2A.
Figure 3:
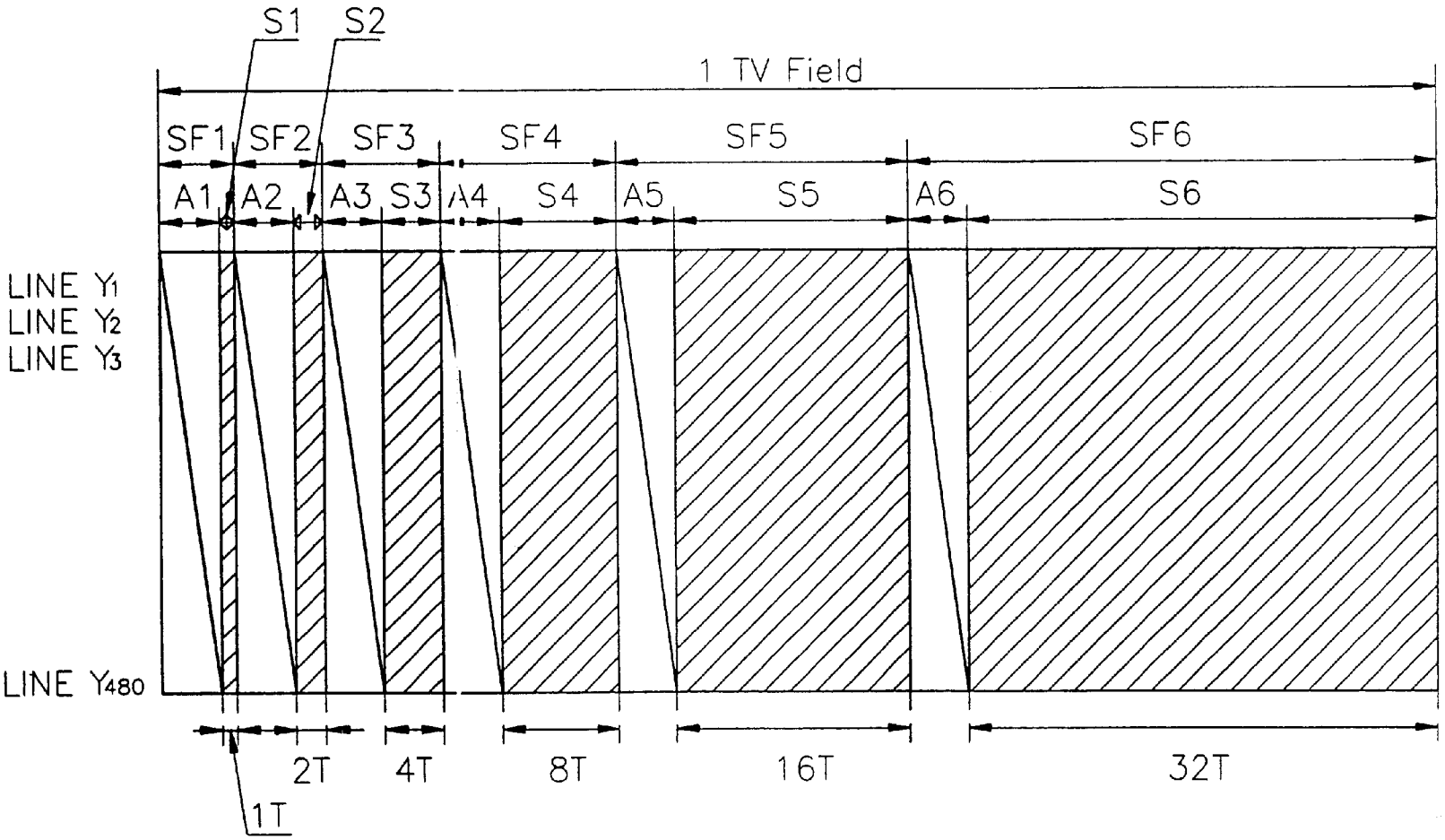
FIG. 3 is a view for explaining a gray scale displaying method of the AC surface discharge plasma display panel.
Figure 4:
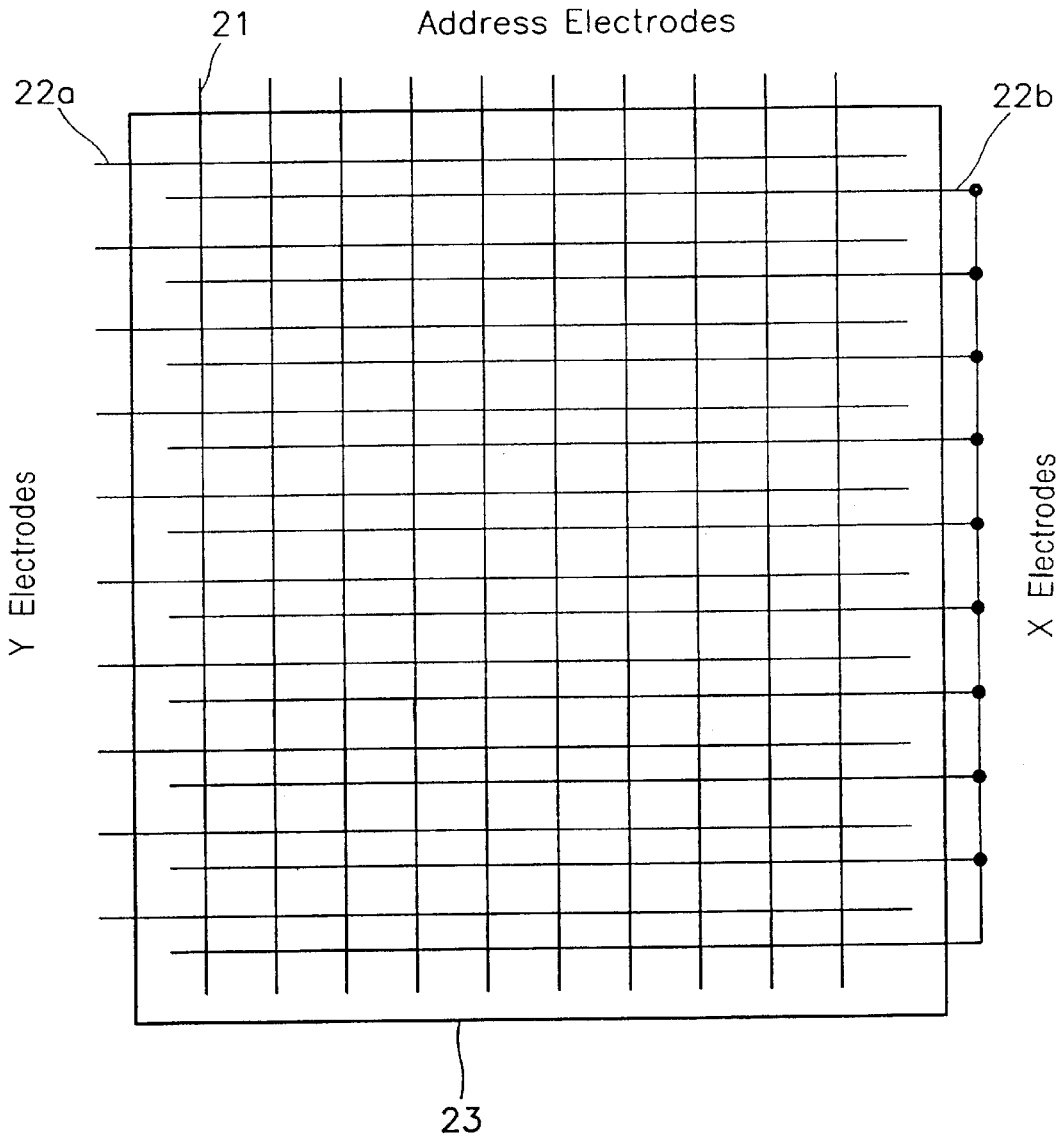
FIG. 4 is a view showing an electrode wiring structure of a conventional AC surface discharge plasma display panel.
Figure 5:
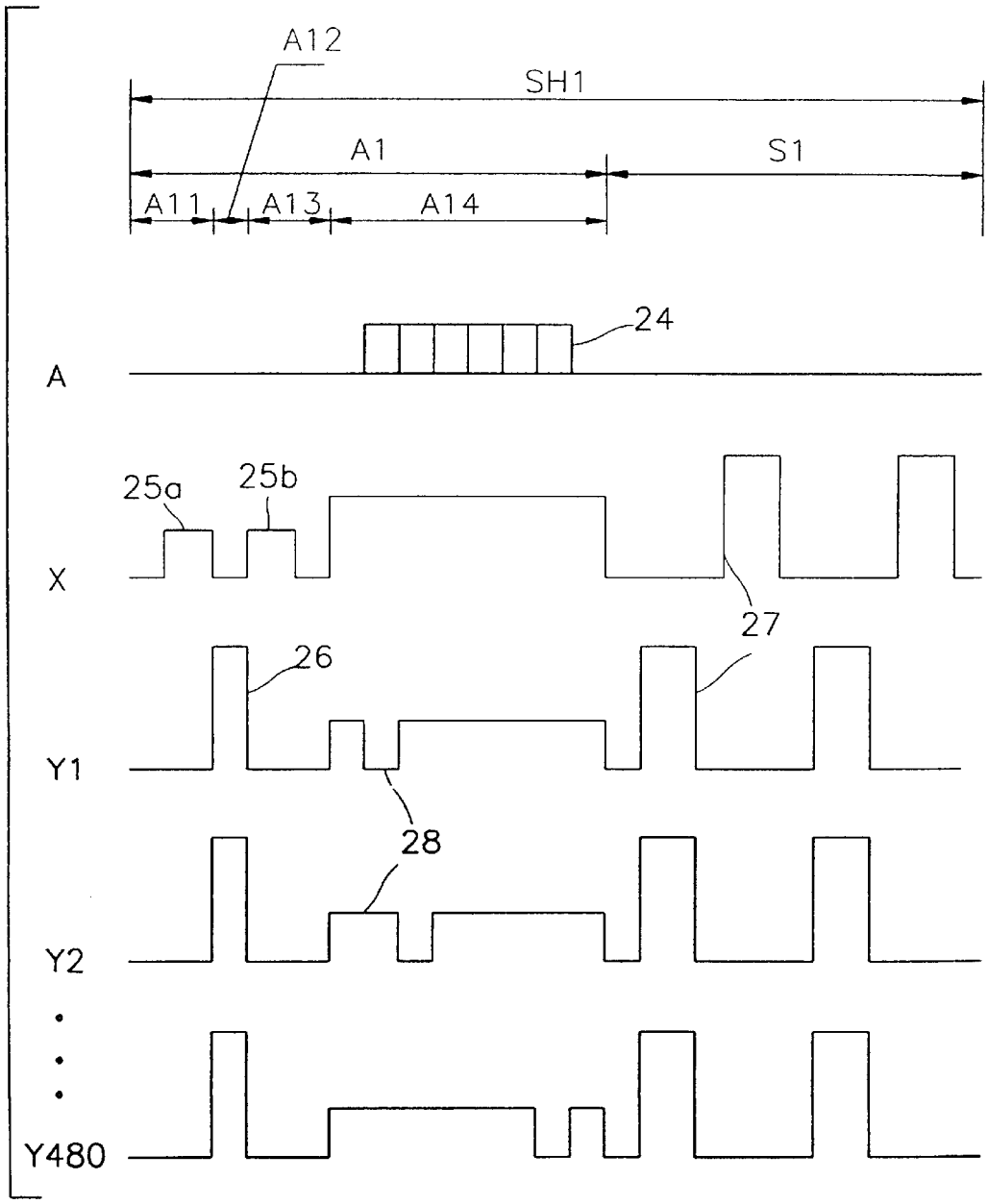
FIG. 5 shows a waveform of a driving signal according to the electrode wiring structure of the AC surface discharge plasma display panel of FIG. 4.
Figure 6:
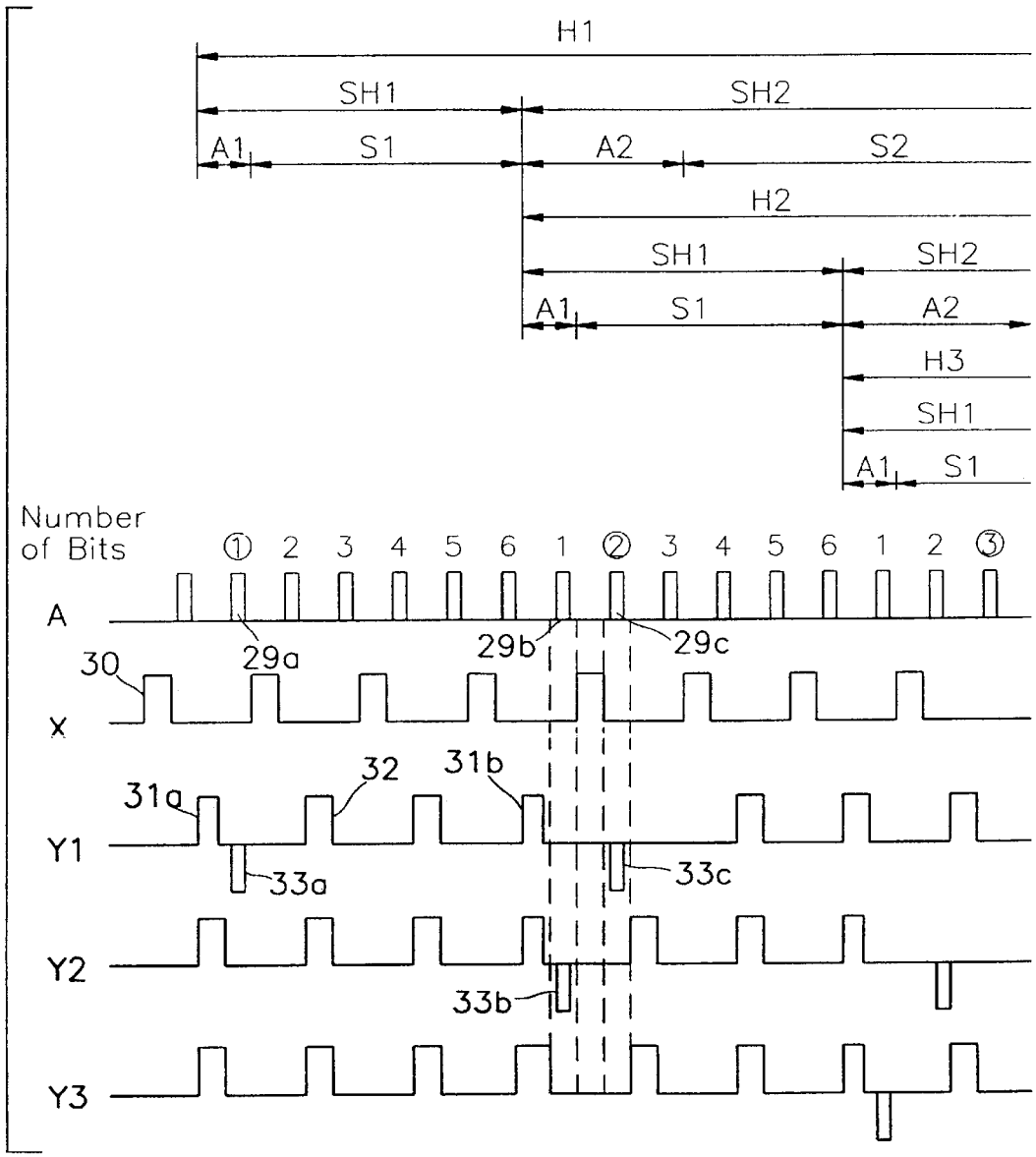
FIG. 6 shows a driving waveform in a method of simultaneously driving an address electrode and a scanning electrode.
Figure 7:
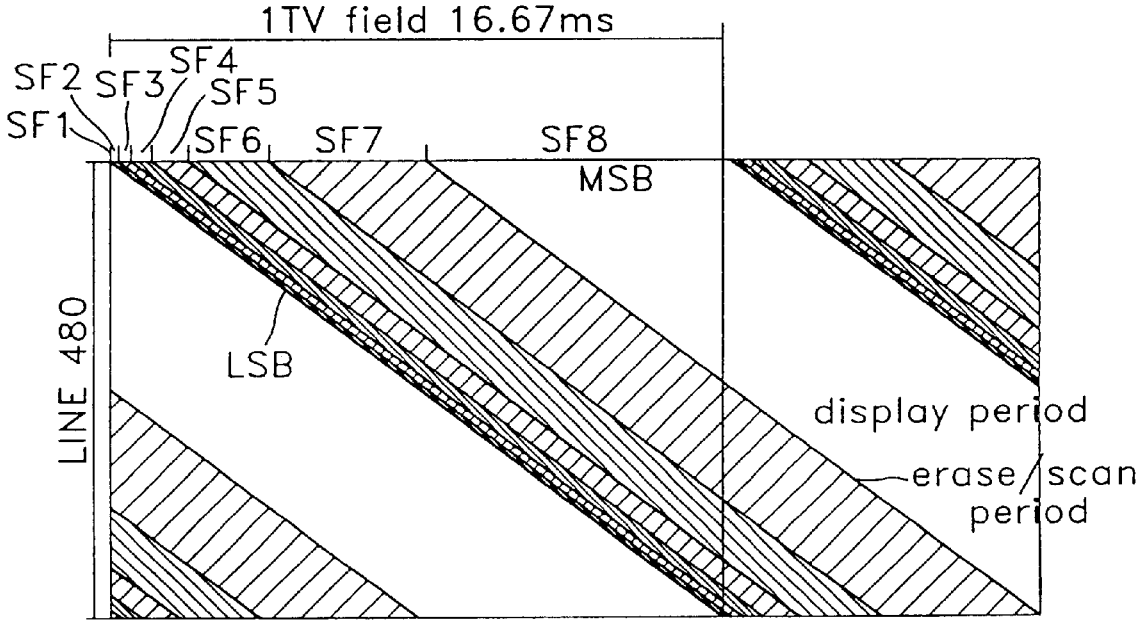
FIG. 7 is a diagram for describing the gray scale displaying method of the method of simultaneously driving the address electrode and the scanning electrode of FIG. 6.
Figure 8:
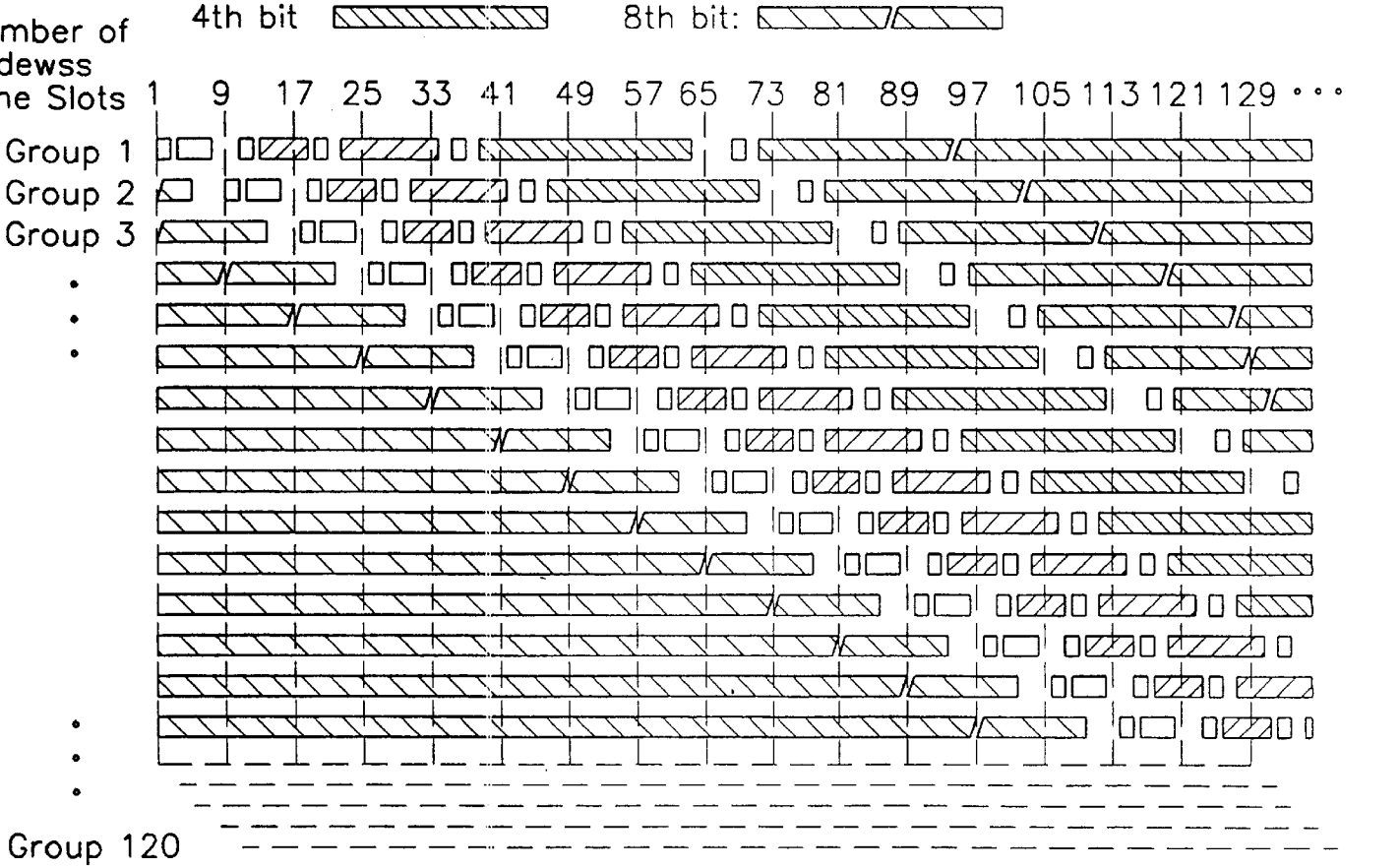
FIG. 8 is a timing diagram of a method of simultaneously driving the address electrode and the scanning electrode according to the present invention.

FIG. 8 is a timing diagram describing an address sustaining discharge simultaneous driving method which is a gray scale displaying method used for the present invention. As shown in FIG. 8, an erase period and a break period exist after an address period and a sustaining period of an nth sub field pass. Then, the address period of an (n+1)th sub field exists. The sustaining period has different times in order to show the brightness of the respective gray scales. In FIG. 8, four scanning electrodes are set to be one electrode group. However, each electrode group can actually be constituted of a plurality of electrodes, for example 8 electrodes. In FIG. 8, such an electrode driving method is applied to one frame. A case where the number of horizontal scan lines is 480 is displayed by the combination of 8-bit reference gray scales, i.e., 256 gray scales in total. In this case, when four address pulses (data) are applied to the address time slot, 120 horizontal scan line groups, each of which is constituted of four scanning electrodes are formed. The arrangements of the break period, the address period, and the sustaining period are as follows. In FIG. 8, the sixth and seventh bits are omitted in a horizontal direction and the 16th through 120th electrode groups are omitted in a vertical direction.

Figure 9:
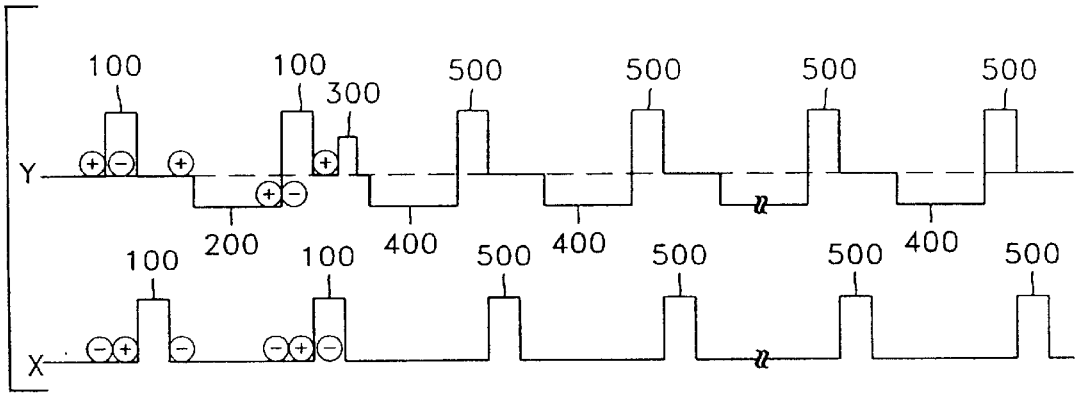
FIG. 9 shows a waveform for explaining an erase operation principle.

FIG. 9 shows an erase operation in the method for driving the plasma display panel according to the present invention. In FIG. 9, reference numeral 100 denotes a sustaining pulse. This shows that the state of a previous sub-field was "on". Reference numeral 200 denotes a bias voltage applied to a scanning electrode. Since the bias voltage has an opposite polarity to that of the wall charge, it does not occur the discharge, however, lowers a scan switching voltage of another line for performing a scanning operation in the same time zone. Reference numeral 300 denotes an erase pulse. The erase pulse erases the wall charge by applying a short and strong pulse right after a display sustaining discharge is completed. Reference numeral 400 denotes a bias voltage. The polarity and value of the voltage are the same as those of the bias voltage of reference numeral 200. However, the bias voltage of reference numeral 400 is for forming the break period. Reference numeral 500 denotes a voltage pulse which is identical to the sustaining pulse of reference numeral 100. However, the voltage pulse 500 does not generate a discharge since it is applied within the break time. The discharge is not generated before the data of the sub field afterward is turned "on" by performing such an operation.

Figure 10:
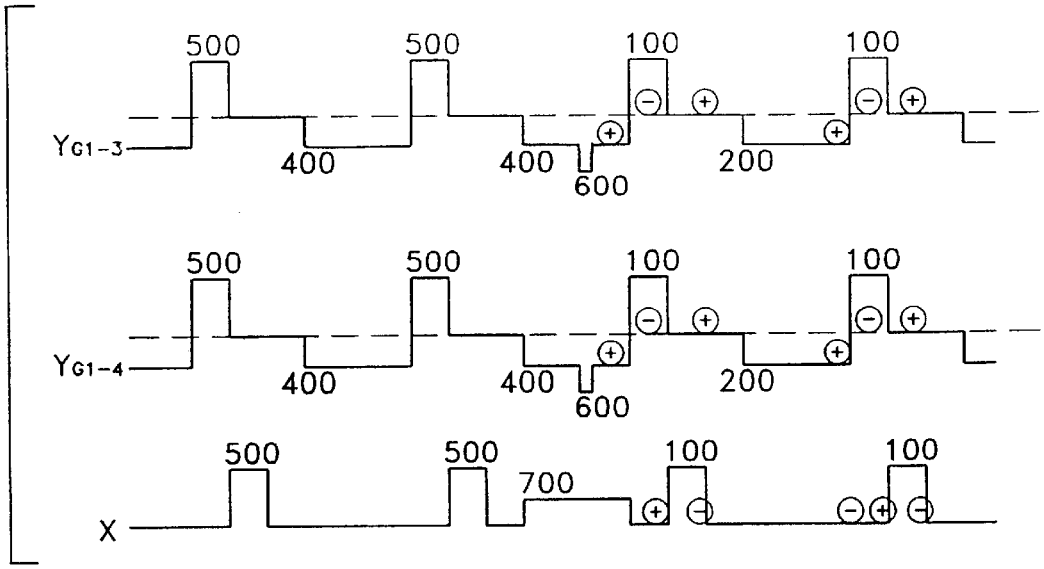
FIG. 10 shows a waveform for explaining a write operation principle in a method for driving a plasma display panel according to the present invention.

FIG. 10 shows a write operation in the method for driving the plasma display panel according to the present invention in detail. A bias voltage of reference numeral 700 is applied to a common electrode (the X electrode) in synchronization with the bias pulse of reference numeral 400 after passing through the break period by the pulses of the reference numerals 500, and 400. A scan pulse of reference numeral 600 is applied using the voltage of the bias pulse of the reference numeral 400 as the reference electric potential. An address pulse (not shown) is applied to the address electrode in synchronization with the scan pulse. In a discharge cell where the write operation is performed by the scan pulse of the reference numeral 600, the display discharge is sustained by the sustaining pulse of the reference numeral 100. The display discharge is sustained until there is an erase operation by the erase pulse 300 shown in FIG. 9.

Figure 11:
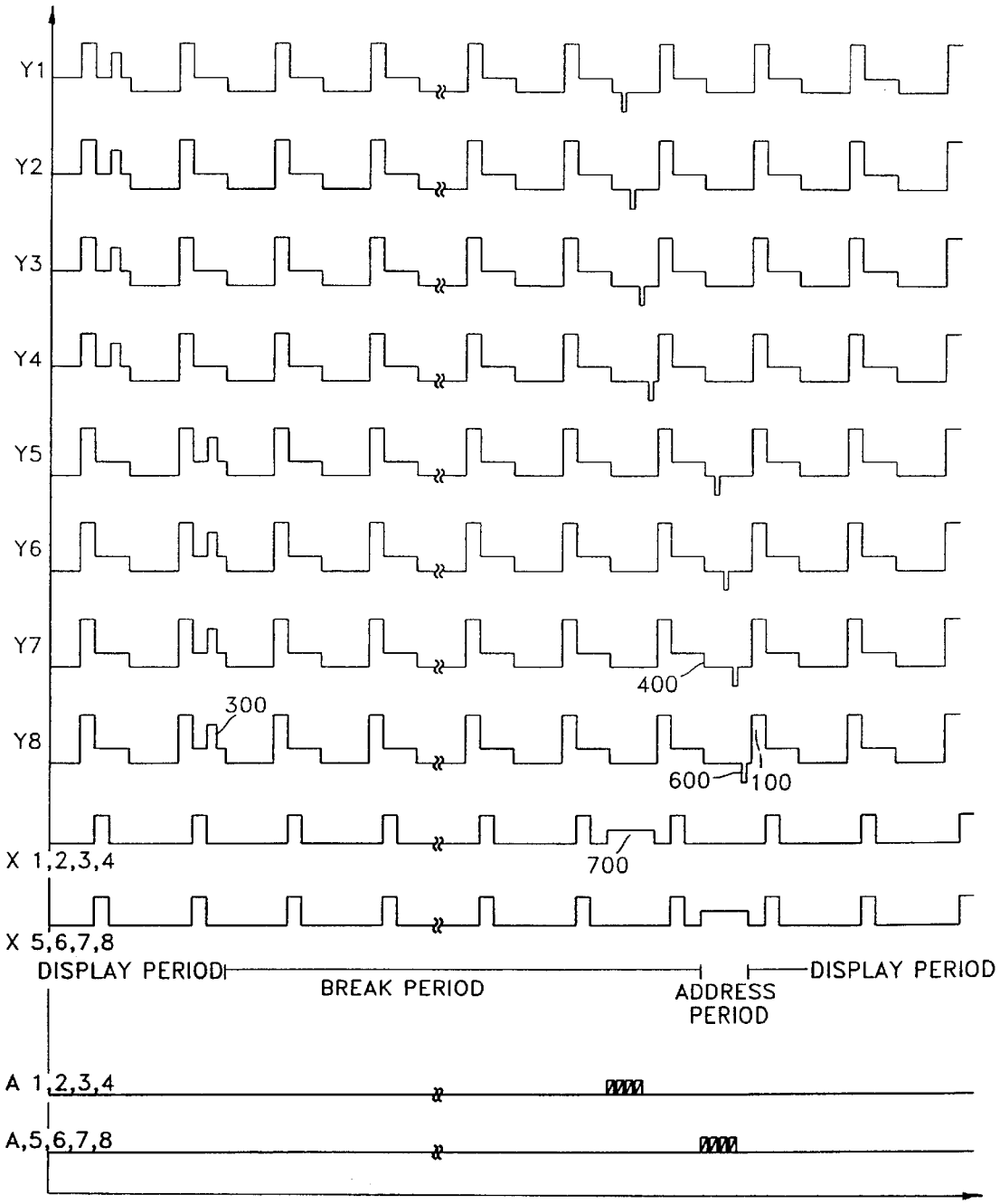
FIG. 11 shows a waveform of a first embodiment of the method for driving the plasma display panel according to the present invention.

FIG. 11 shows a first embodiment where the method for driving the plasma display panel according to the present invention is actually applied to the three-electrode AC plasma display panel. In the first embodiment, the electrode driving waveforms of FIGS. 9 and 10 are used. In FIG. 11, only the driving waveforms of 8 electrode lines are shown for convenience sake. Since the driving waveforms of the other electrode lines are similar to the displayed driving waveforms, they will be omitted. The 8 electrode lines are divided into two electrode groups of four lines each. The lines do not mean the number of lines of real panels but show the arrangement relationship assigned to each sub field. Therefore, the waveforms are not sequentially scanned by the lines of the panels but are sequentially scanned by the arrangement relationship of each sub field.

In the first embodiment, according to the waveform of the sustaining pulse, the termination (the start) time of the sustaining pulse applied to the Y electrode coincides with the start (the termination) time of the sustaining pulse applied to the X electrode or a time between the sustaining pulse applied to the Y electrode and the sustaining pulse applied to the X electrode is asymmetrical. In FIG. 11, there is no temporal margin between the sustaining pulses by applying the sustaining pulse to the X electrode right after the discharge maintaining pulse is applied to the Y electrode. After applying the sustaining pulse to the X electrode, the bias voltage pulse is applied to the Y electrode after forming a temporal margin within which the erase pulse can be applied. The bias voltage applied to the Y electrode is continuously applied to all over the sub field region like the sustaining pulse. It is possible to reduce the number of switching devices and to simplify the structure of the switching device by removing switching in each line of the switching device during the construction of a driver by continuously applying the bias voltage applied to the Y electrode all over the sub field region. A bias voltage 700 is applied to the X electrode in a period between the sustaining pulses where the address operation occurs. The bias voltage 700 is turned "on" after a position to which the erase voltage 300 is assigned until before the first scan pulse 600 is applied and is turned "off" after the last scan pulse 600 is applied until before the first sustaining pulse 100 is applied.

Figure 12:
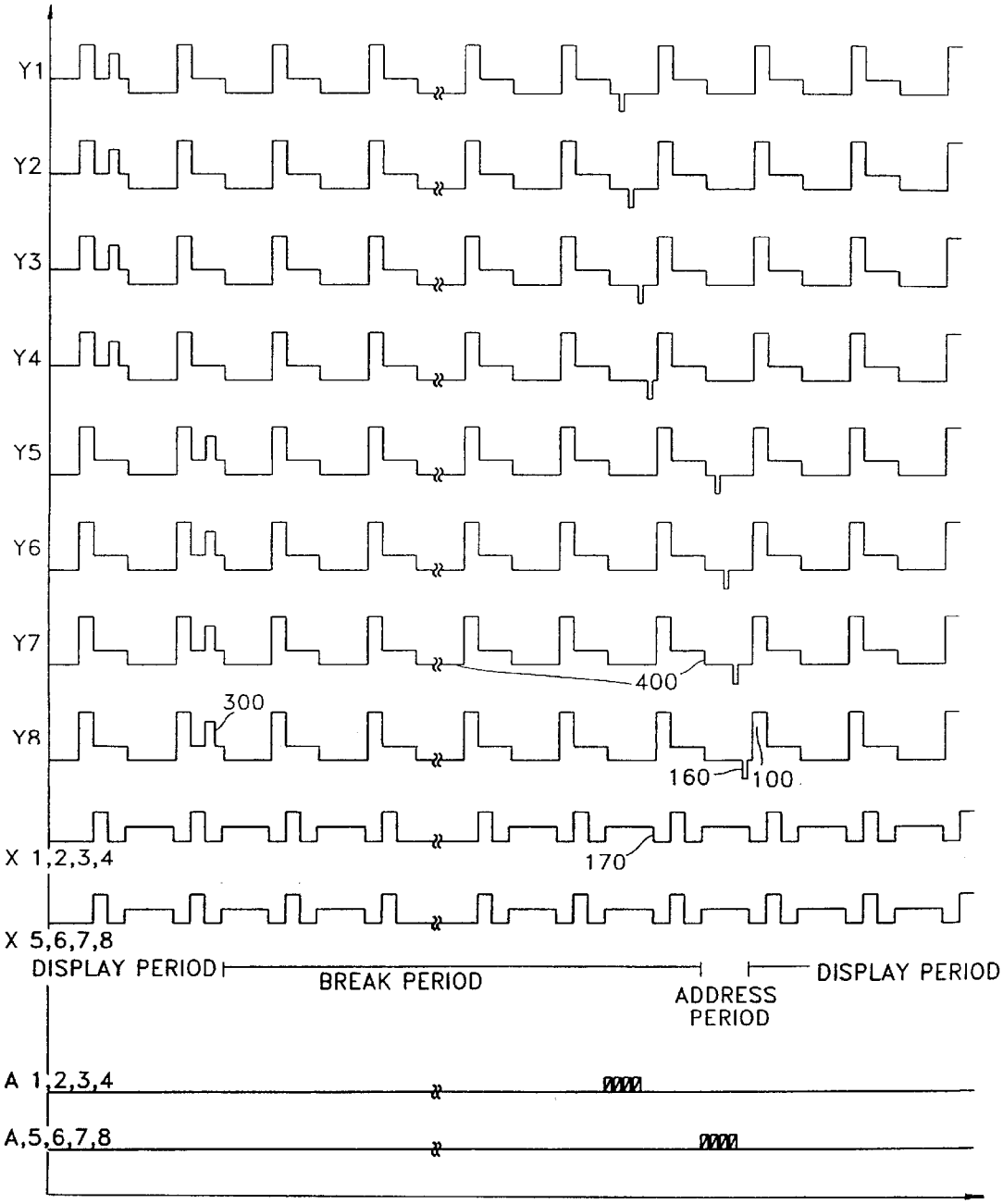
FIG. 12 shows a waveform of a modified embodiment of the method for driving the plasma display panel according to the present invention.

FIG. 12 shows a waveform of the modified embodiment of the first embodiment. The bias voltage applied to the X electrode is continuously applied to all over the sub field. As shown in FIG. 11, when the bias voltage 700 is applied only in a period where the scan pulse 600 is applied to the X electrode in the first embodiment, the switching device should be used in each electrode line in the X electrode. Since the switching device is required in each line in the X electrodes of the plasma display panel, it is expensive and the circuit becomes complicated. In order to solve this problem, the bias voltage 700 is continuously applied to the X electrode all over the sub field as shown in FIG. 12. Other operations are the same as shown in FIG. 11.

Figure 13:
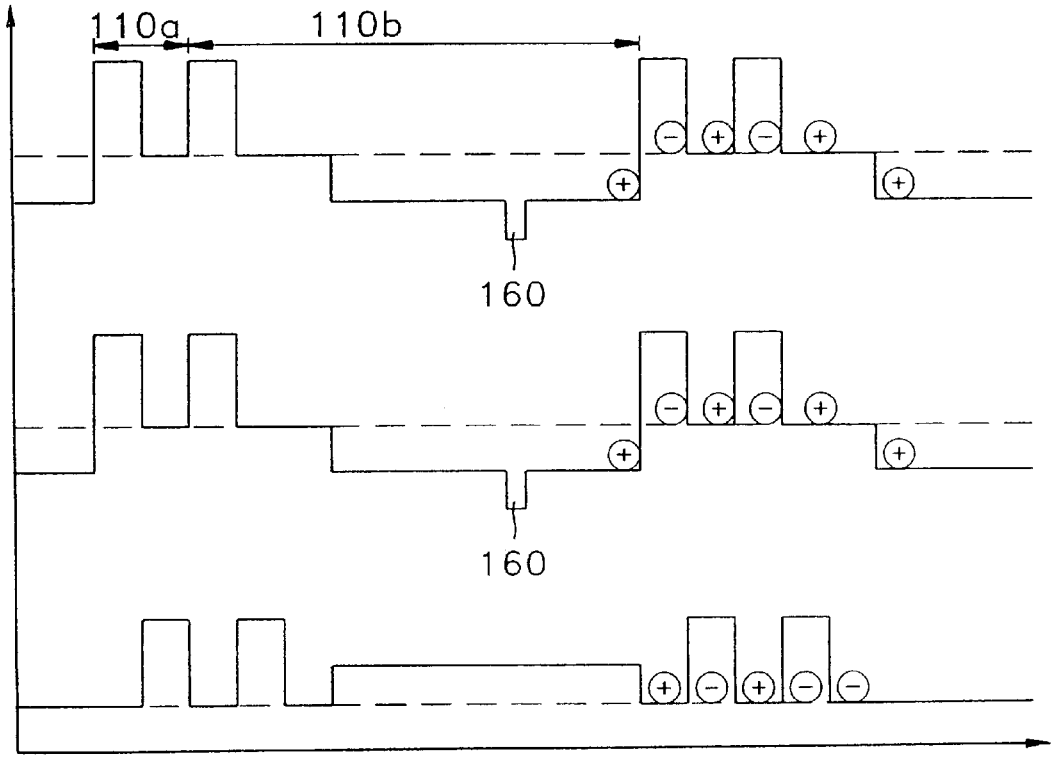
FIG. 13 shows a waveform of a method for applying a double sustaining pulse in the method for driving the plasma display panel according to the present invention.

FIG. 13 shows a waveform of a second embodiment of the method for driving the plasma display panel according to the present invention. Namely, in the second embodiment, a double discharge maintaining pulse (msp) is used. As shown in FIG. 13, the sustaining pulse applied to the Y electrode or the X electrode has two pulses in each period. One pulse has a short pulse width 110*a* and the other pulse has a relatively long pulse width 110*b*. The sustaining pulses of the Y electrode and the X electrode, having the short pulse width 110*a*, are alternately arranged. At this time, the long pulse width 110*b* of the sustaining pulse is used for performing the erase and write operations. The short pulse width 110*a* of the sustaining pulse contributes to multiple discharges in order to obtain high brightness. The long pulse width 110*b* of the sustaining pulse operates as shown in FIG. 11 and determines the appropriate number of time slots (data pulses) which are put into each address pocket according to the pulse width and the number of necessary scan lines. By doing so, it is possible to construct the address time slot required for displaying the high definition (HD) by forming many time slots in the pulse width of one sustaining pulse. Namely, it is possible to secure an appropriate number of time slots required for displaying the HD in the address time slot.

Figure 14:
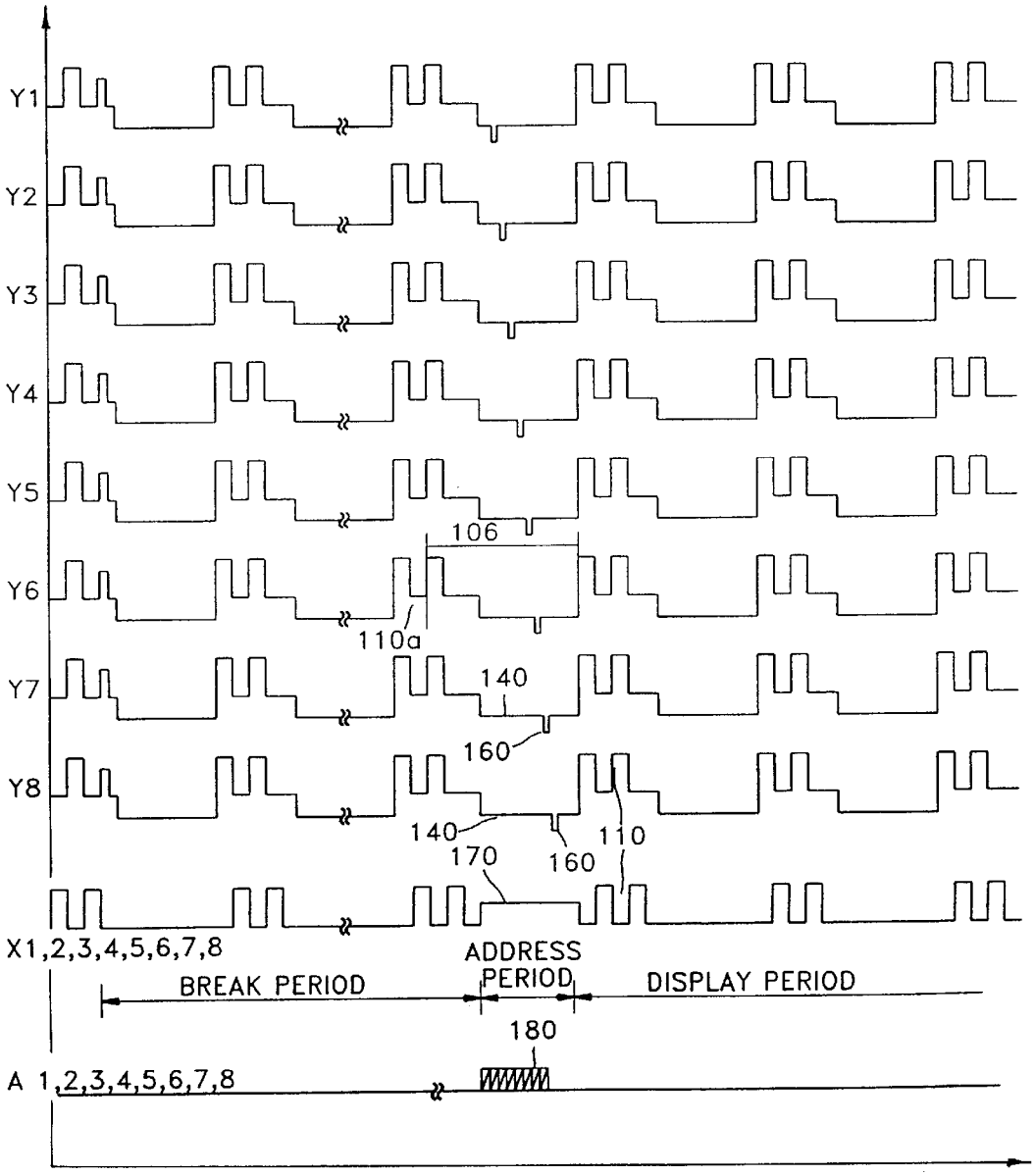
FIG. 14 shows a waveform of a second embodiment of the method for driving the plasma display panel according to the present invention using the method of applying the double sustaining pulse of FIG. 13.

FIG. 14 shows an address while display (AWD) waveform of 8 lines realized by the method of using the double sustaining pulse of FIG. 13. After the sustaining electrode group of the short pulse width 110*a* completes the operation; a bias pulse 140 is applied to the scan electrode with a margin of a period for an erase pulse 130. A scan pulse 160 is applied using the bias voltage 140 as the reference electric potential. An address pulse 180 (a data pulse) is applied in synchronization with the scan pulse 160. After the address period is completed, the sustaining pulse 110 is applied, thus performing the sustaining discharge. In FIG. 14, 8 time slots 180 (data pulses) are formed within the long pulse width 110*b* of the sustaining pulse. However, the number is not set. It is possible to form a plurality of time slots. The number of formed time slots is closely dependent on the pulse width of the sustaining pulse and the width of the address pulse 180. In the sustaining pulse, the respective pulses are not necessarily alternately applied. It is possible to continuously apply a plurality of sustaining pulses having the same width.

Figure 15:
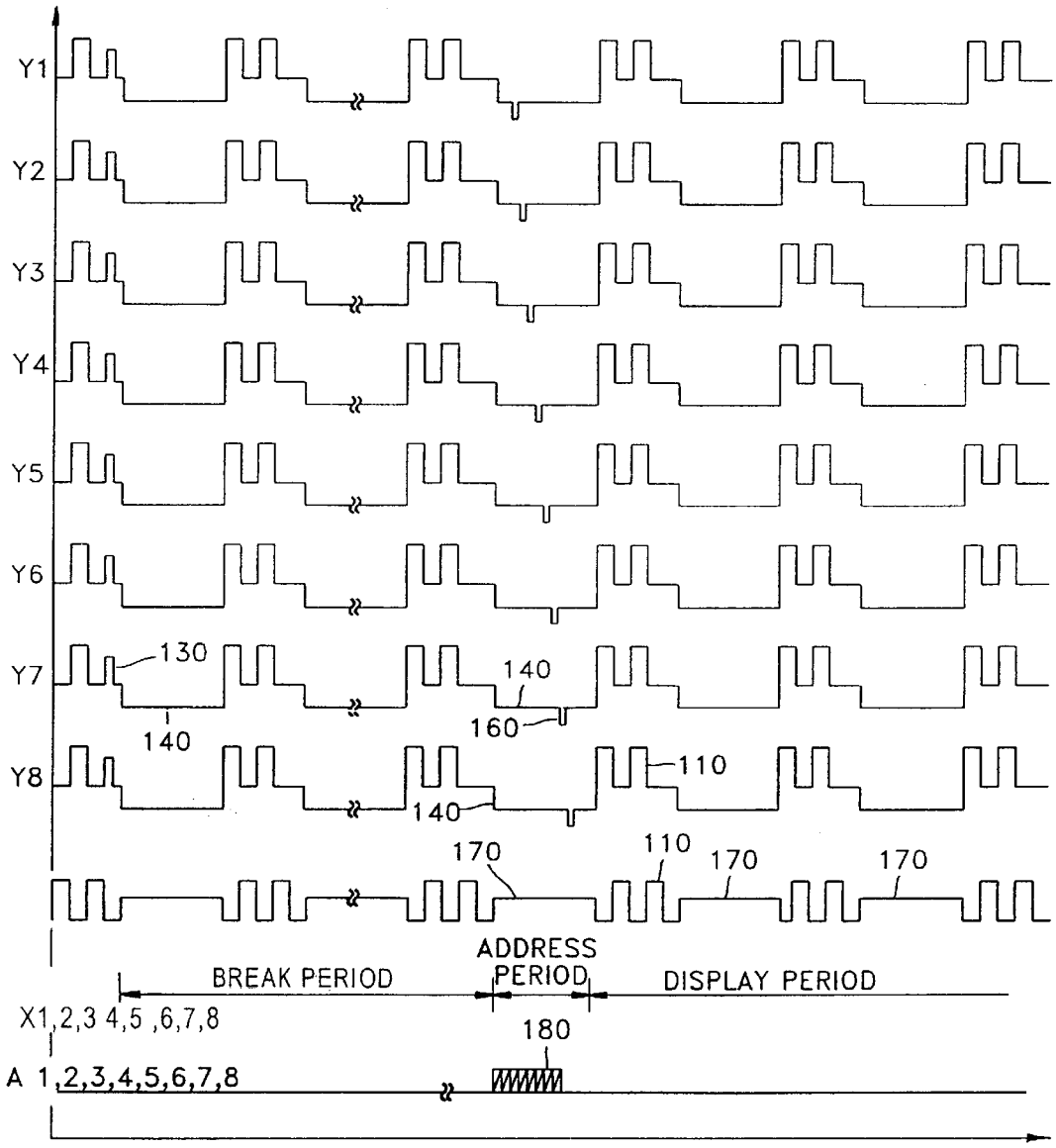
FIG. 15 shows a waveform of a modified embodiment of the second embodiment of FIG. 14.

FIG. 15 shows a modified embodiment of the 8-line AWD waveform in the method of using the double sustaining pulse of FIG. 14. In the embodiment, the bias voltage of the sustaining electrode is continuously applied to all over the sub field. By doing so, as described in the modified example of the first embodiment as shown in FIG. 12, it is possible to reduce the number of driving switching devices.

Figure 16:
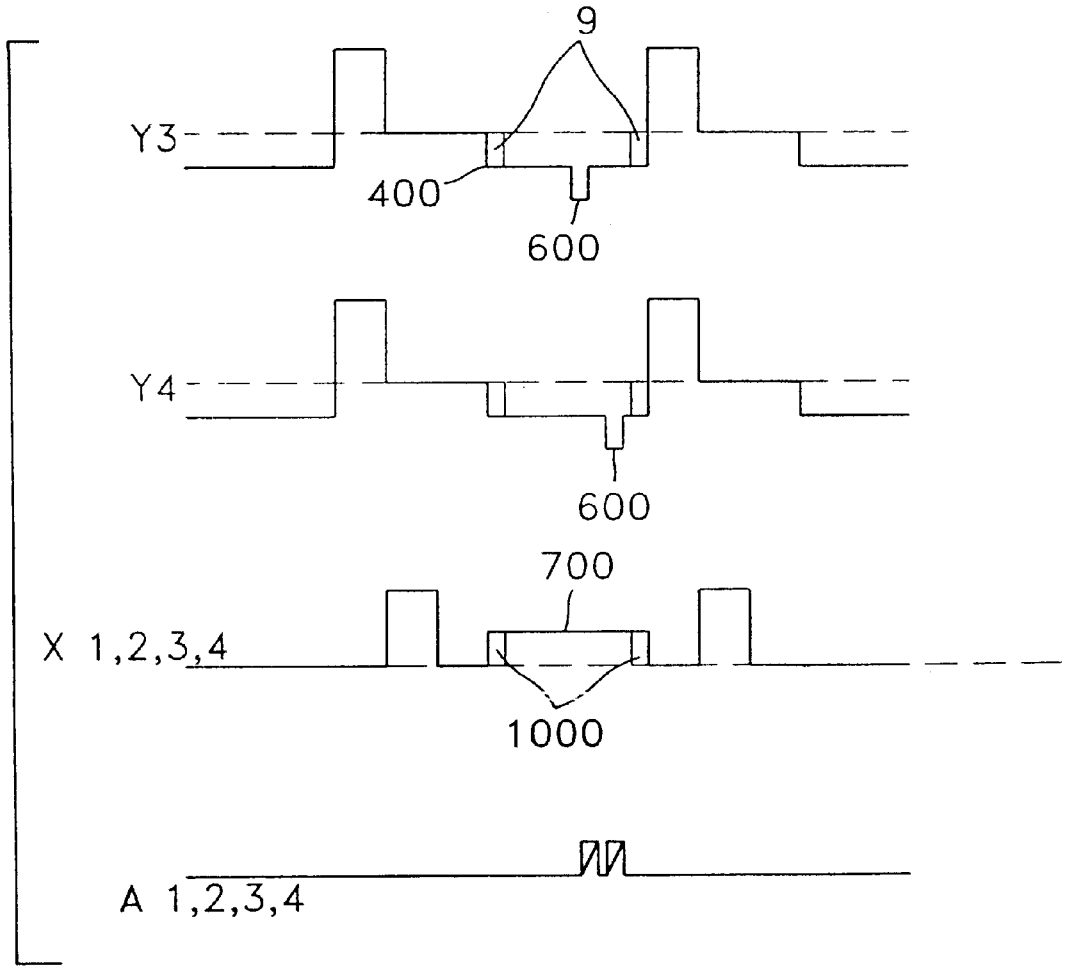
FIG. 16 shows a detailed waveform of a time margin given to a bias pulse so as to perform a stable operation in the method for driving the AC plasma display panel according to the present invention.

FIG. 16 is a view showing the position to which the bias pulse 400 applied to the Y electrode and the X electrode is applied. The bias pulse 400 is applied in a break period between a previous sustaining pulse and the sustaining pulse. The application starting position is turned "on" right after the previous sustaining operation is completed until before the first scan pulse 600 applied in the break period is applied. The bias pulse 400 must be continuously applied and turned "off" right after the last scan pulse 600 is terminated until before the next sustaining pulse is applied. The parts marked with a dotted line are application time margins 900 and 1,000 of the bias pulse. The application time margins of the bias pulse should be identically applied to the second embodiment where the double sustaining pulse is used.

Figure 17:
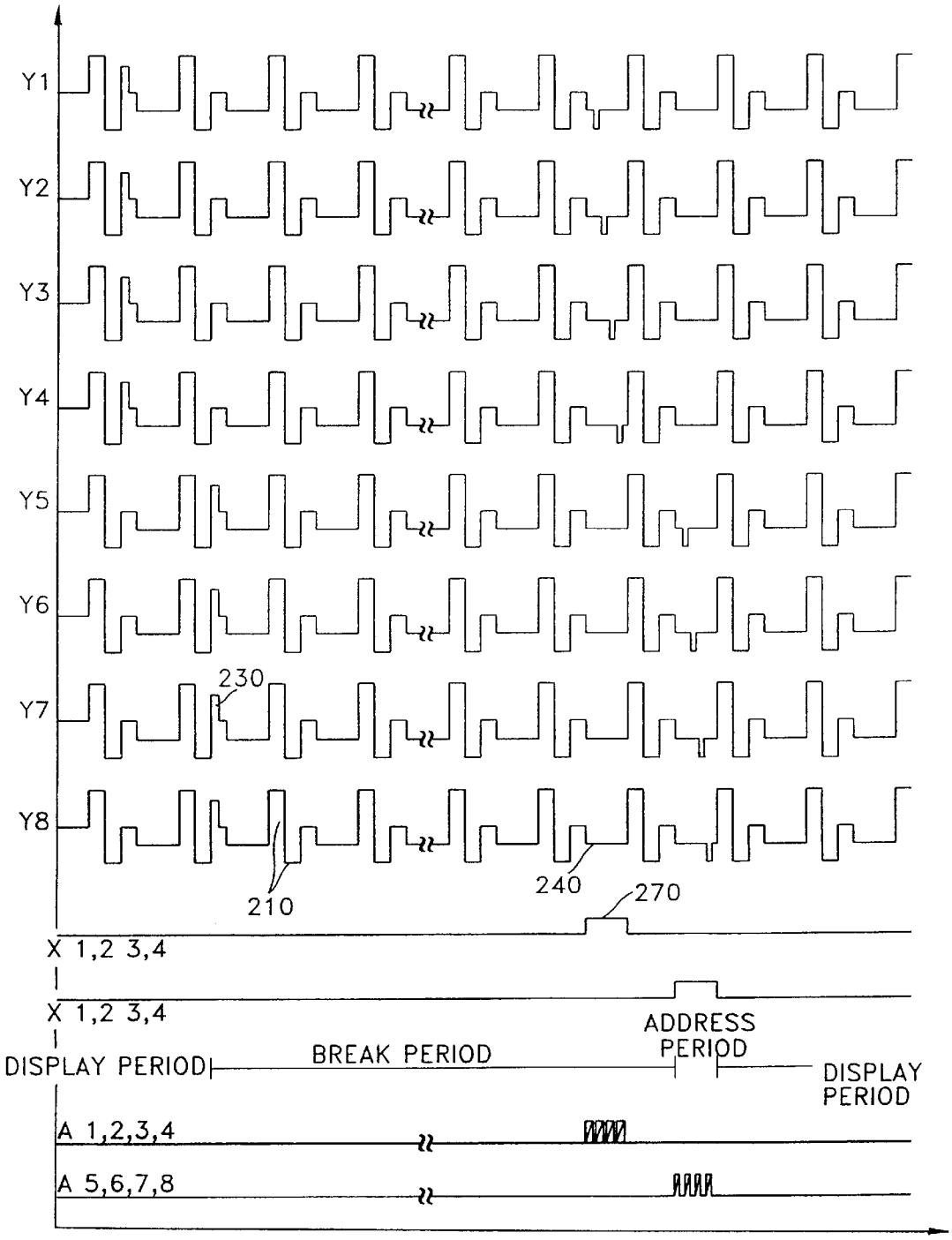
FIG. 17 shows a waveform of a third embodiment of the method for driving the plasma display panel according to the present invention.

FIG. 17 shows a waveform of a third embodiment of the plasma display panel according to the present invention. As described above, the sustaining pulse is continuously applied to all over the TV field time in the method for driving the plasma display panel, according to the present invention. As shown in FIG. 17, in the third embodiment, a sustaining pulse 210 is applied to only the Y electrodes (the scanning electrodes). Only a bias pulse 270 is applied to the X electrodes. In FIG. 17, reference numeral 230 denotes an erase pulse. Reference numeral 240 denotes a bias pulse applied to the Y electrode.

Figure 18:
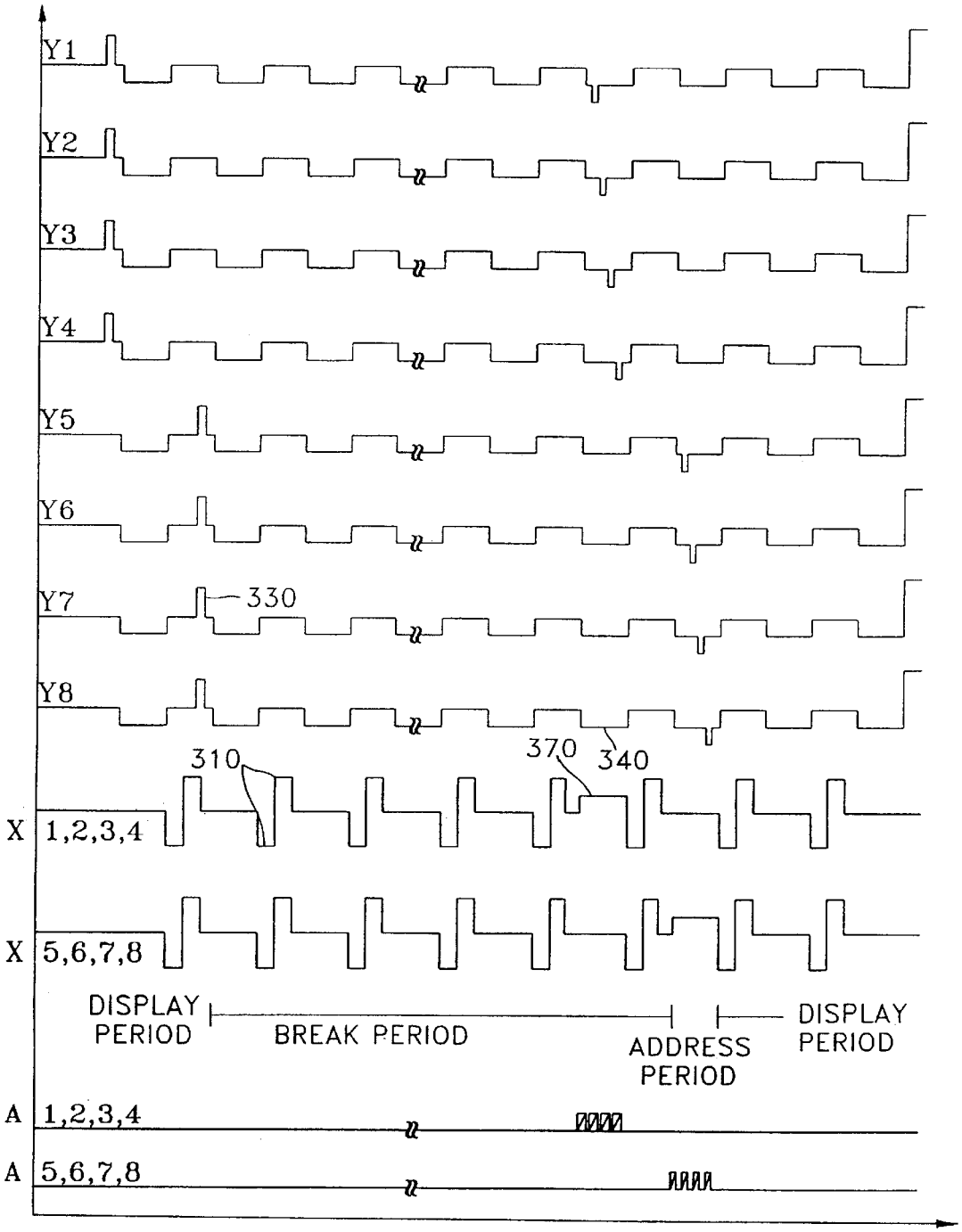
FIG. 18 shows a waveform of a fourth embodiment of the method for driving the plasma display panel according to the present invention.

FIG. 18 shows a waveform of a fourth embodiment to which the concept of the third embodiment shown in FIG. 17 is applied. As shown in FIG. 18, the sustaining pulse is applied to the horizontal electrodes of one side in the fourth embodiment. Namely, the sustaining pulse is applied through the X electrodes. Only the erase pulse, the bias pulse, and the scan pulse are applied to the Y electrodes. When the driving pulse is applied using the method described in the fourth embodiment, it is possible to simply load a scan driver IC.

Figure 19:
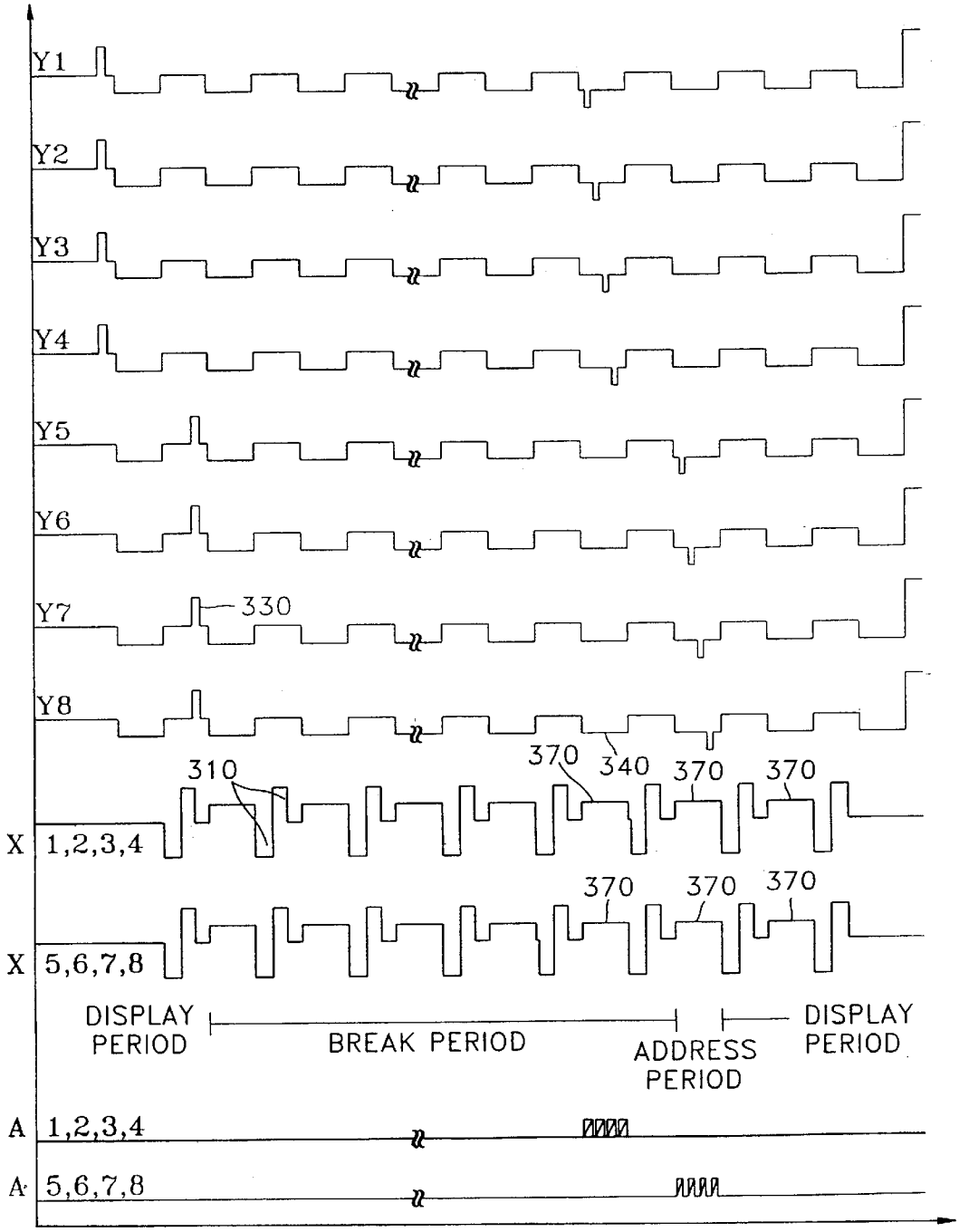
FIG. 19 shows a waveform of a modified embodiment of the fourth embodiment of FIG. 18.

FIG. 19 shows a waveform of the modified example of the fourth embodiment shown in FIG. 18. When a method of applying the sustaining pulse to only the X electrodes is used as described in the fourth embodiment, the bias pulse applied to the X electrodes is applied to all over the TV field. When this method is used, it is possible to reduce the number of the switching devices for applying the bias pulse of the X electrodes as mentioned above. Accordingly, the entire structure is simplified.

As mentioned above, in the method for driving the AC type plasma display panel according to the present invention, there is a phase difference of no more than 180° between the sustaining pulse applied to the Y electrode and the sustaining pulse applied to the X electrode in the three-electrode structure AC type plasma display panel in order to secure time for sustaining uniform wall charge and space charge characteristics. An address pocket constituted of a plurality of data pulses is set in a temporal margin space secured by collecting a plurality of sustaining pulses into a group. The data of each address time slot is assigned to pockets of a plurality of sub fields and is addressed. For this, the horizontal electrodes are divided into a plurality of groups, each group consisting of as many horizontal electrode pairs as data pulses of the address time slot. Ones of the horizontal electrode pairs is commonly wired to each group. The others of the horizontal electrode pairs are independently wired. Data of the address pockets in the respective electrode groups are sequentially scanned. The electrode groups are applied to an address display simultaneous driving method. The scanning pulse of the scanning electrode group synchronized with each address time slot exists above a bias pulse having an arbitrary electric potential existing between the sustaining pulses. At this time, the X electrode group has a uniform electric potential in a section where the address pocket exists in a time between the sustaining pulse groups. By driving the plasma display panel in this way, the brightness as displayed on the panel is increased. Also, the brightness is not reduced although the number of the horizontal scan lines is increased.

What is claimed is:

1. An AC plasma display panel driving method for driving a picture of a frame with a realization of gray scales by dividing each horizontal synchronous period into a plurality of periods, sustaining and selectively emitting light during the plurality of periods by sequentially applying a different number of sustaining pulses to scanning electrodes and common electrodes during each divided period in a k×n matrix AC plasma display panel where k electrode pairs, each of which is comprised of first and second electrodes formed in parallel on each surface of two substrates opposite to each other, are arranged in strips and n third electrodes are arranged in strips to cross the electrode pairs, each of which is comprised of the first and second electrodes, when common wiring groups are formed by wiring an m number of second electrodes into one node as a common electrode and the first electrodes are individually installed as a scanning electrode in the electrode pair, comprising the steps of:

(a) applying a sustaining pulse to the scanning electrode to alternate with a sustaining pulse applied to the common electrode;

(b) setting an address time slot comprised of m data in a temporal marginal period secured to the sustaining pulse applied to m scanning electrodes corresponding to the common electrodes of a common electrode groups, each of which is comprised of m common electrodes, performing addressing by assigning the data of the respective address time slots to the time slots of a plurality of sub fields, and applying one-scan pulse to each of the m scanning electrodes so as to be synchronized with the m data, wherein the scan pulses exist above a first bias pulse of a predetermined electric potential applied between the sustaining pulses; and (c) applying a second bias pulse of a predetermined voltage to the common electrodes of each common electrode group in a period when the address time slot which exists between the sustaining pulses exists, simultaneously with the step (b).

2. The method of claim 1, further comprising the step of applying the same erase pulse in units of m scanning electrodes in the same period between the sustaining pulse and the first bias pulse so that an erase period and a break period exist after an address period comprised of the address time slot period and a sustaining period to which the sustaining pulse is applied in each sub field in the steps (a), (b), and (c).

3. The method of claim 1, wherein the second bias pulse is continuously applied to between the sustaining pulses applied to the common electrode in the step (c).

4. The method of claim 1, wherein the sustaining pulse applied to the scanning electrode has a polarity opposite to that of the first bias pulse.

5. The method of claim 1, wherein the sustaining pulse applied to the common electrode has the same polarity as that of the second bias pulse.

6. The method of claim 1, wherein the first bias pulse and the second bias pulse are turned on right after a previous sustaining pulse is terminated until before they are applied to the first scan pulse applied in a break period and are turned off after the last scan pulse is terminated until before the next discharge maintaining pulse is applied.

7. The method of claim 1, wherein the sustaining pulse is applied twice in the step (a).

8. The method of claim 7, further comprising the step of applying the same erase pulse in units of m scanning electrodes in the same period between the sustaining pulse and the first bias pulse so that an erase period and a break period exist in each sub field after an address period comprised of the address time slot period and a sustaining period to which the sustaining pulse is applied pass in the steps of (a), (b), and (c).

9. The method of claim 7, wherein the second bias pulse is continuously applied to between the sustaining pulses applied to the common electrode in the step (c).

10. The method of claim 7, wherein the polarity of a sustaining pulse applied to the scanning electrode is opposite to that of the first bias pulse.

11. The method of claim 7, wherein the polarity of a sustaining pulse applied to the common electrode is the same as that of the second bias pulse.

12. The method of claim 7, wherein the first bias pulse and the second bias pulse are turned on right after a previous sustaining pulse is terminated until before the first scan pulse applied in the break period and are turned off after the last scan pulse is terminated until before the next sustaining pulse is applied.

13. The method of claim 1, wherein the discharge maintaining pulse applied to the common electrode is applied to the scan electrode together with the sustaining pulse applied to the scanning electrode.

14. The method of claim 13, wherein the second bias pulse is continuously applied to the common electrode in a period between the sustaining pulses applied to the scanning electrode in the step (c).

15. The method of claim 1, wherein the sustaining pulse applied to the scanning electrode is applied to the common electrode together with the sustaining pulse applied to the common electrode.

16. The method of claim 15, wherein the second bias pulse is continuously applied to between the sustaining pulses applied to the common electrode in the step (c).

* * * * *